US005402041A

United States Patent [19]

Kishino et al.

[11] Patent Number: 5,402,041

[45] Date of Patent: Mar. 28, 1995

[54] FIELD EMISSION CATHODE

[75] Inventors: Takao Kishino; Koichi Nishiuchi; Shigeo Itoh, all of Mobara, Japan

[73] Assignee: Futaba Denshi Kogyo K.K., Mobara, Japan

[21] Appl. No.: 37,806

[22] Filed: Mar. 26, 1993

[30] Foreign Application Priority Data

Mar. 31, 1992 [JP] Japan ..... 4-077278

[51] Int. Cl.[6] ..... G09G 3/10

[52] U.S. Cl. ..... 315/169.1; 313/336

[58] Field of Search ..... 315/169.1, 334, 337, 315/169.3; 313/309, 336, 351, 495, 308, 422; 445/2, 5, 6, 59

[56] References Cited

U.S. PATENT DOCUMENTS

| | | | |
|---|---|---|---|
| 3,500,102 | 3/1970 | Crost et al. | 313/495 |
| 3,581,148 | 5/1971 | Brignet | 315/169.3 |
| 3,622,828 | 11/1971 | Zinn | 313/495 |
| 3,755,704 | 8/1973 | Spindt et al. | 313/309 |
| 4,904,895 | 2/1990 | Tsukamoto et al. | 313/336 |
| 4,908,539 | 3/1990 | Meyer | 315/169.3 |
| 5,053,673 | 10/1991 | Tomii et al. | 313/308 |
| 5,189,341 | 2/1993 | Itoh et al. | 315/169.1 |
| 5,256,936 | 10/1993 | Itoh et al. | 313/495 |

*Primary Examiner*—Raymond A. Nelli

*Attorney, Agent, or Firm*—Oblon, Spivak, McClelland, Maier, & Neustadt

[57] ABSTRACT

A field emission cathode capable of permitting a display to be carried out at increased density and a circuit incorporated therein together with an FEC to exhibit satisfactory characteristics and being driven according to a static drive system. A plurality of control lines and data wires are arranged in a matrix-like manner on a monocrystalline Si substrate, to thereby form element regions on the substrate. The element regions each are formed therein with a circuit element, on which a field emission section is laminated. The circuit elements each include a first transistor connected to both data wire and control wire and functioning as a switching element, a capacitor serving as a circuit for storing therein a signal input thereto, and a second transistor for amplifying a signal input thereto and feeding it to the field emission section.

3 Claims, 5 Drawing Sheets

FIELD EMISSION CATHODE

BACKGROUND OF THE INVENTION

This invention relates to a field emission cathode, and more particularly to a field emission cathode suitable for use as an electron source for a fluorescent display device, particularly, a graphic fluorescent display device, as well as an electron source for a light source in the filed of lithography to which a principle of a fluorescent display device is applied.

Various kinds of field emission cathodes were proposed for the purpose of application to a display element such as a fluorescent display device or the like.

For example, when the field emission cathode is applied to a graphic fluorescent display device, electrodes are arranged in a matrix-like configuration to selectively determine turning-on and turning-off of a display section on an anode side of the fluorescent display device. More specifically, in the field emission cathode, any two of an emitter electrode array of the field emission cathode and its gate electrode array and grid electrodes of the fluorescent display device and its anode electrodes are arranged so as to intersect each other, resulting in forming a matrix configuration. When any desired intersections in such a matrix are selected depending on an image to be displayed, electrons are emitted from the field emission cathode in correspondence to the intersections selected and then impinged on phosphors of the anode electrodes, so that selection of picture cells may be carried out.

Unfortunately, it was found that the conventional field emission cathode of the X—Y matrix structure described above has several problems.

One of the problems is that the field emission cathode is driven according to a dynamic driving system, so that its luminous time depends on a duty ratio, to thereby cause luminous time for each of picture cell to be reduced with an increase in the number of picture cells to be scanned, leading to a decrease in luminance.

Another problem is that the dynamic driving system causes a circuit therefor to be complicated as compared with a static driving system.

A further problem is that in the conventional field emission cathode, it is required to form an external circuit, leading to large-sizing of the overall field emission cathode and an increase in manufacturing cost thereof.

In view of the foregoing problems of the conventional field emission cathode, the assignee proposed such an electron source as disclosed in Japanese Patent Application No. 95119/1990. More particularly, the electron source proposed is so constructed that wirings of an X—Y matrix configuration are formed on an insulating substrate and then thin-film transistors (TFT) and field emission cathodes (FEC) are juxtaposed to each other within a plurality of element regions defined on the insulating substrate by the X—Y matrix wirings.

In order to permit a thin film transistor to produce a large current, it is required to increase an area of the transistor. Also, in a field emission cathode using a thin film transistor, arrangement of the field emission cathode on the thin film transistor through an insulating layer deteriorates performance of the thin film transistor; therefore, it is necessarily required to juxtapose the field emission cathode and thin film transistor to each other. Thus, the electron source proposed which includes a combination of the thin film transistors and field emission cathodes has a disadvantage of causing utilization thereof per unit area to be deteriorated.

Further, in the above-described conventional field emission cathode and electron source, the field emission cathode is prepared in silicon (Si) arranged on an insulating substrate such as a glass substrate or the like. Unfortunately, such arrangement causes mobility of electrons to be decreased, resulting in failing to permit the thin film transistor to exhibit desired characteristics.

SUMMARY OF THE INVENTION

The present invention has been made in view of the foregoing disadvantages of the prior art.

Accordingly, it is an object of the present invention to provide a field emission cathode which is capable of permitting a display to be carried out with significantly increased density.

It is another object of the present invention to provide a field emission cathode which is capable of being driven according to a static driving system capable of increasing a duty cycle of the field emission cathode, resulting in exhibiting high luminance at a decreased anode voltage.

It is a further object of the present invention to provide a field emission cathode which is capable of reducing an area of the field emission cathode for each of picture cells.

It is still another object of the present invention to provide a field emission cathode which is capable of substantially increasing mobility of electrons, to thereby exhibit satisfactory circuit characteristics.

It is yet another object of the present invention to provide a field emission cathode which is capable of effectively preventing emission of a fluorescent display device from being deteriorated when the field emission cathode is used for the fluorescent display device.

In accordance with the present invention, a field emission cathode is provided. The field emission cathode comprises a monocrystalline Si substrate, matrix-like wirings constructed of a plurality of wirings laminatedly formed on the Si substrate so as to extend in each of two directions perpendicular to each other, circuit elements respectively formed in a plurality of element regions defined on the Si substrate by the matrix-like wirings and each including a switching element and a storage circuit. The circuit elements are connected at an input section thereof to the matrix-like wirings. The field emission cathode also includes field emission sections each formed in each of the element regions and connected to an output section of each of the circuit elements.

In a preferred embodiment of the present invention, the switching element is connected to the matrix-like wirings and the storage circuit is constructed so as to store therein a signal input thereto by means of the switching element, and each of the circuit elements further includes a drive circuit for amplifying the signal stored in the storage circuit and feeding it to the field emission section.

BRIEF DESCRIPTION OF THE DRAWINGS

These and other objects and many of the attendant advantages of the present invention will be readily appreciated as the same becomes better understood by reference to the following detailed description when considered on connection with the accompanying drawings in which like reference numerals designate like or corresponding parts throughout; wherein.

DETAILED DESCRIPTION OF THE PREFERRED EMBODIMENT

Figure 1:
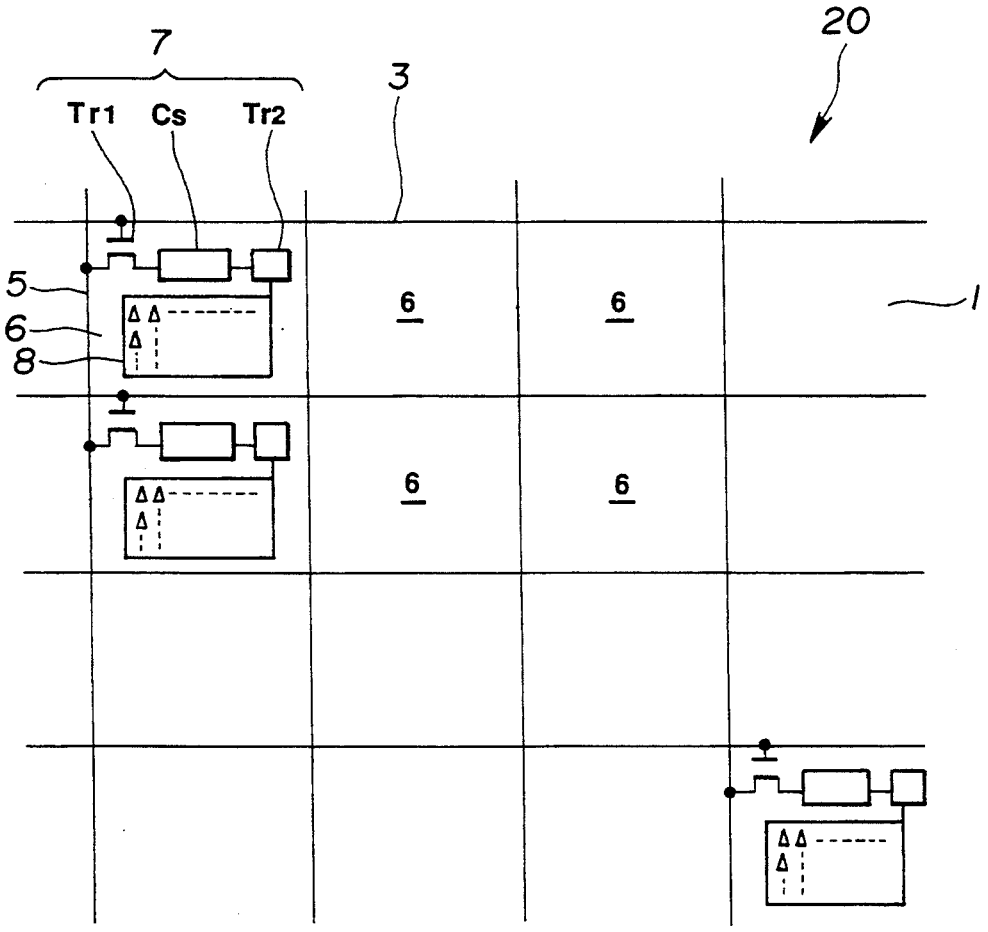
FIG. 1 is a circuit diagram generally showing an embodiment of a field emission cathode according to the present invention.

A field emission cathode according to the present invention will be described hereinafter with reference to the accompanying drawings.

Referring first to FIGS. 1 to 7, an embodiment of a filed emission cathode according to the present invention is illustrated. A field emission cathode of the illustrated embodiment, as shown in FIG. 1 to 3B, includes a monocrystalline Si substrate (hereinafter referred to also as "Si substrate") 1, on which a plurality of strip-like control wires 3 are arranged through an insulating layer 2 made of $SiO_2$ in a manner to extend in an X-direction and be spaced from each other at predetermined intervals. Then, on the control wires 3 are arranged a plurality of strip-like data wires 5 through an insulating layer 4 of $SiO_2$ in a manner to extend in a Y-direction perpendicular to the X-direction and be spaced from each other at predetermined intervals. The control wires 3 and data wires 5 are formed of an A1 thin film and arranged so as to intersect each other, to thereby form matrix-like wirings, resulting in a plurality of element regions 6 being defined on the Si substrate 1 by the matrix wirings thus formed.

Figure 2:
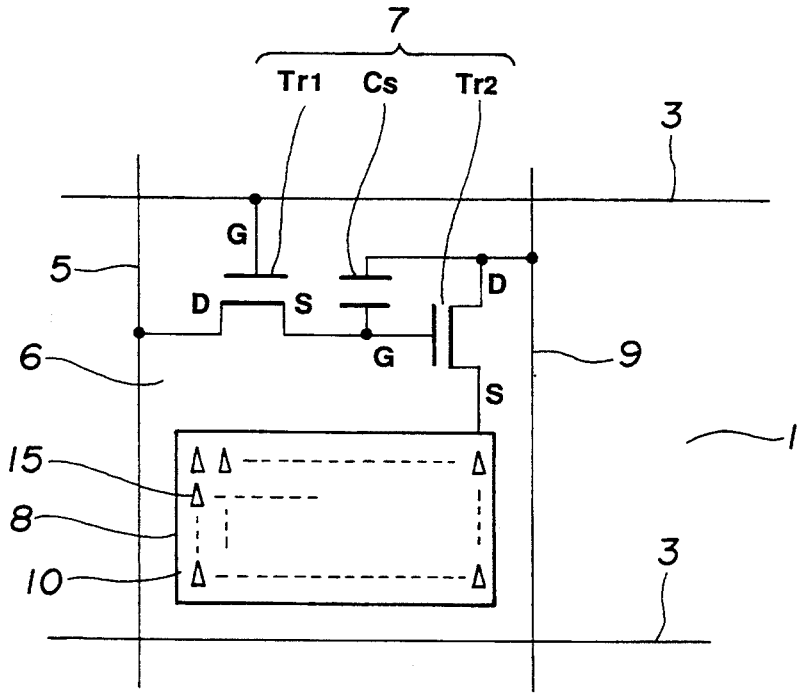
FIG. 2 is a circuit diagram showing one element region in the field emission cathode of FIG. 1.

As shown in FIGS. 1 to 3, the Si substrate 1 is provided thereon with a circuit element 7 and a field emission section 8 for each of the element regions 6. In the illustrated embodiment, the circuit element 7, as shown in FIG. 2, comprises a transistor Tr1 acting as a switching element, a capacitor Cs acting as a storage circuit, and a transistor Tr2 acting as a drive circuit for amplifying an output signal and feeding the field emission section 8 with the amplified output signal.

Figure 3A:
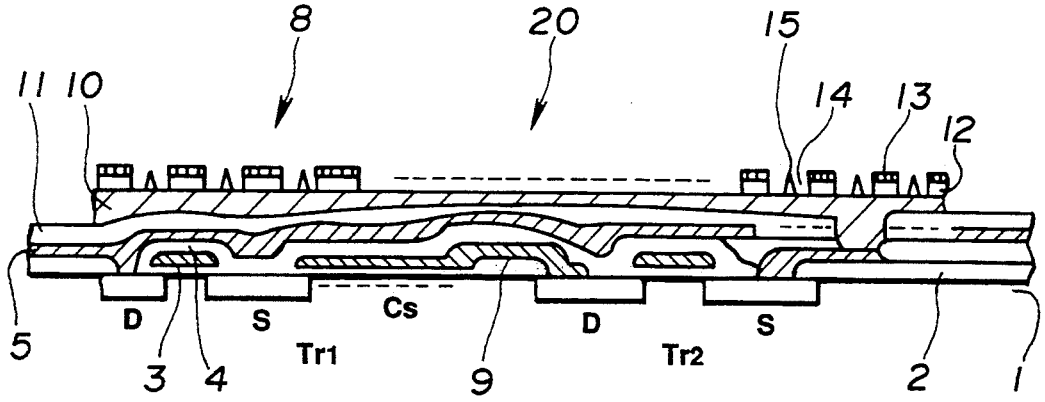
FIG. 3A is a sectional view of the field emission cathode shown in FIG. 1.
Figure 3B:
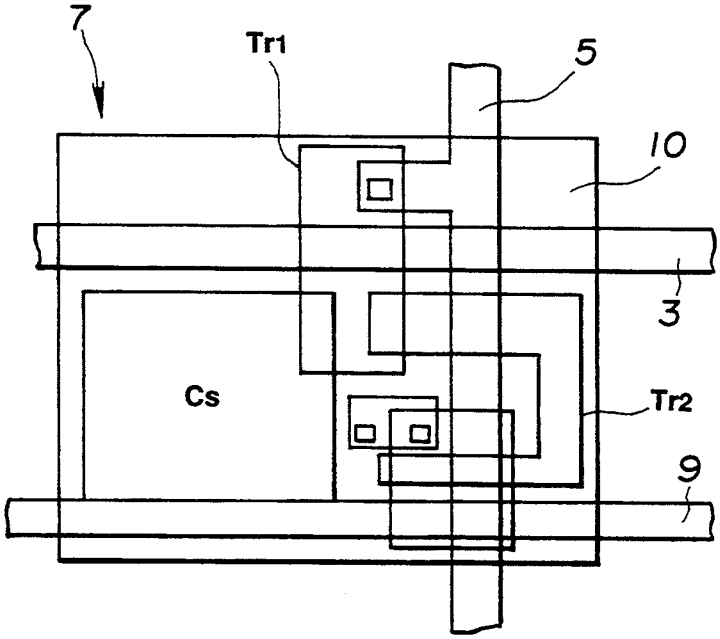
FIG. 3B is a plan view of the field emission cathode shown in FIG. 1.

The transistors Tr1 and Tr2 each are a MOS type transistor incorporated in an surface of the Si substrate. The transistor Tr1, as shown in FIG. 2 or FIGS. 3A and 3B, has a drain D on an input side thereof connected to the data wire 5 and a gate G connected to the control line 3. A source S of the transistor Tr1 is connected to both one end of the capacitor Cs and a gate G of the transistor Tr2. The other end of the capacitor Cs and a drain D of the transistor Tr2 are connected to a power line 9. Also, the transistor Tr2 has a source on an output side thereof connected to an underlay electrode 10 of the field emission section 8. The drain and source of each of the transistor Tr1 and Tr2 each are an $n^+$ layer formed on the Si substrate 1 and the gate thereof is made of poly-silicon or high-melting metal (metal silicide).

The field emission section 8 is a field emission element formed for every element region 6 and, as shown in FIGS. 3A and 3B, laminatedly arranged on the control wires 3 and data wires 5 forming the matrix-like wirings and the circuit elements 7 through the insulating layer 11. More particularly, the underlay electrode 10 is arranged on an insulating layer 11 and then an insulating layer 12 made of $Si_3N_4$, $Al_2O_3$ or the like is formed on the insulating layer 11. Further, a gate 13 which is formed of a Nb layer or the like is arranged on the insulating layer 12. The gate and insulating layer 12 are formed with holes 14, in each of which an emitter 15 of a cone-like shape is arranged on the underlay electrode 10. The emitters 15 each are made of Mo, Ti, W or the like and deposited on the underlay electrode 10.

Now, the manner of operation of the field emission cathode of the illustrated embodiment thus constructed will be described hereinafter.

Selection of any desired combination of the data wires 5 and control wires 3 which cooperate together to form the X—Y matrix permits the transistor Tr1 on each of the element regions 6 at intersections between the data wires selected and the control wires selected to be rendered conductive, so that a display signal fed through the data wires 5 is stored in the capacitor Cs through the transistor Tr1.

After the storage, application of the signal to the underlay electrode 10 of the field emission section 8 through the transistor Tr2 permits the field emission section at each of desired positions in the X—Y matrix to emit electrons. Also, control of the transistor Tr2 which functions as the drive circuit permits the amount of electrons emitted from the field emission section 8 to be controlled, so that it is possible to carry out adjustment of luminance and gradation in display.

Figure 4:
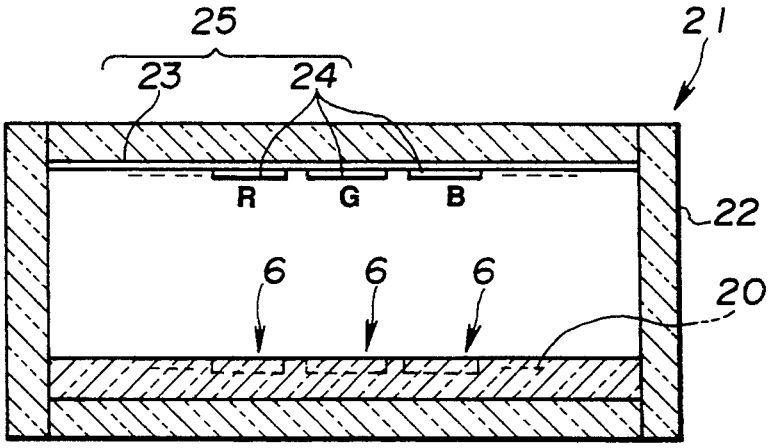
FIG. 4 is a sectional view showing a fluorescent display device to which the field emission cathode shown in FIG. 1 is applied.

FIG. 4 shows an example wherein the field emission cathode of the illustrated embodiment designated at reference numeral 20 is mounted in an envelope 22 of a fluorescent display device 21 so as to function as an electron source for the device 21. The envelope 22 is provided on an inner surface thereof opposite to the field emission cathode 22 with an anode 25 constructed of an anode conductor 23 and phosphor layers 24 deposited on the anode conductor 23. When a single-color display is desired, the anode 25 is formed all over the inner surface. When a multi-color display desired, display segments R, G and B respectively corresponding to red, green and blue luminous colors are arranged so as to correspond to the element regions 6 of the field emission cathode 20, respectively.

Figure 5:
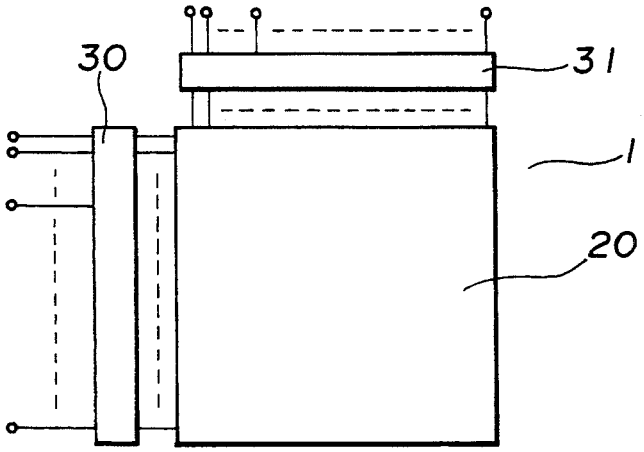
FIG. 5 is a plan view showing a modification of the field emission cathode shown in FIG. 1.

FIG. 5 shows a modification of the field emission cathode of the illustrated embodiment, wherein a driver 30 on an X-side (control wire side) and a driver 31 on a Y-side (data wire side) are integratedly formed on a Si substrate 1 on which an X—Y matrix section of the field emission cathode 20 is arranged. Also, the modification may be constructed in such a manner that function circuits for image processing and the like other than the driver circuits are formed on the same Si substrate.

A conventional graphic display devices includes a display device of the so-called chip-on-glass type, wherein driver ICs are mounted on a glass substrate. Unfortunately, the display device has a disadvantage that connection between terminals of the ICs and those of display elements is troublesome. The modification of FIG. 5 is constructed so as to use the Si substrate 1 as a common substrate, therefore, it is possible to incorporate the drivers 30 and 31 in an outer periphery of the Si substrate 1 corresponding a periphery of a display section. The drivers 30 and 31 thus incorporated may be connected to matrix-like wirings by means of a wiring pattern on the Si substrate.

Figure 6:
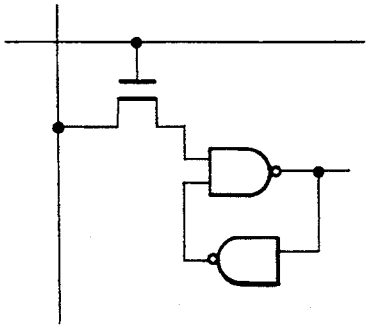
FIG. 6 is a circuit diagram showing a modification of a storage circuit in the field emission cathode shown in FIG. 1.

FIG. 6 shows a modification of the storage circuit constituting a part of the circuit element 7 in the field emission cathode of the above-described embodiment. A storage circuit of FIG. 6 comprises a latch circuit system using a flip-flop circuit.

Figure 7:
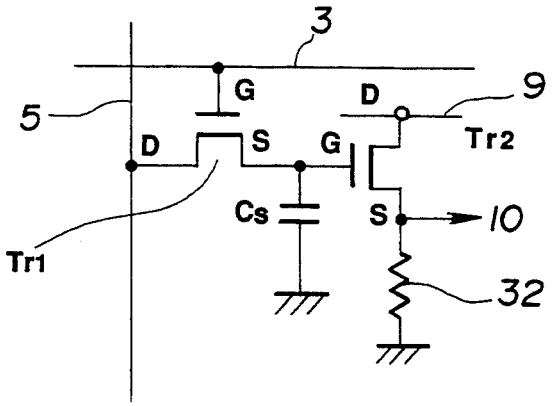
FIG. 7 is a circuit diagram showing a modification of a drive circuit in the field emission cathode shown in FIG. 1.

FIG. 7 shows a modification of the drive circuit constituting a part of the circuit element 7 in the field emission cathode of the above-described embodiment. In the modification, a transistor Tr2 is grounded at a source thereof through a resistor 32. Also, a connection between the resistor 32 and the source of the transistor Tr2 is connected to an underlay electrode 10 of a field emission section, resulting in an output signal being derived therefrom.

Figure 8:
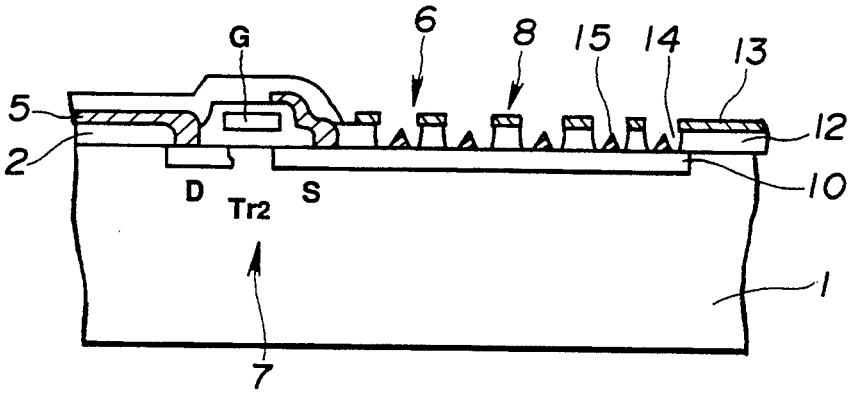
FIG. 8 is a sectional view showing a modification of a field emission section in the field emission cathode shown in FIG. 1.

FIG. 8 shows a modification of the field emission section 8 in the field emission cathode of the embodiment described above. In the modification, a field emission section 8 is formed at a location of an element region 6 adjacent to a circuit element 7. An underlay circuit 10 of the field emission section 8 is incorporated in a Si substrate 1 and connected to a source of a transistor Tr2 functioning as a drive circuit.

Figure 9:
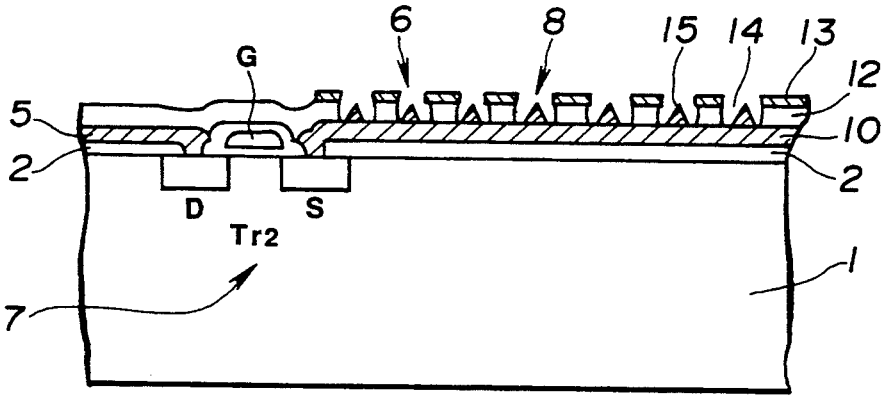
FIG. 9 is a sectional view showing a further modification of a field emission section in the field emission cathode shown in FIG. 1.

FIG. 9 shows another modification of the field emission section 8 in the field emission cathode of the embodiment described above.. In the modification as well, a field emission section 8 is formed at a location of an element region 6 adjacent to a circuit element 7. However, an underlay 10 of the field emission section 8 is made of a thin film of metal formed on a Si substrate 1 unlike that in the modification of FIG. 8.

As can be seen from the foregoing, the field emission cathode of the present invention exhibits a variety of advantages.

One of the advantages is that a number of element regions defined on the substrate by the matrix-like wirings exhibit a memory function, so that the field emission cathode of the present invention may be driven according to a static driving system. Thus, when a single-color display is desired, a duty cycle of the field emission cathode is permitted to be increased to a level as high as about 1, whereas when a multi-color display is desired, it is permitted to be increased to about $\frac{1}{3}$; therefore, the field emission cathode exhibits luminance of a high level even at a decreased anode voltage.

Also, the field emission cathode of the present invention permits the circuit elements to be integrally formed under the field emission section, resulting in being significantly decreased in area for every picture cell.

A driving IC is conventionally known in the art which is formed on a glass substrate using amorphous Si or polycrystalline Si. However, the field emission cathode of the present invention wherein the circuit elements are formed on the monocrystalline Si substrate permits mobility of electrons to be increased to a level 100 to 1000 times as large as the conventional driving IC, resulting in the circuit characteristics being improved.

A fluorescent display device for color display generally uses a sulfide phosphor for a display section of an anode. Therefore, use of a thermal oxide cathode as an electron source for such a fluorescent display device causes sulfide gas to be produced, which is then reacted with the cathode, leading to deterioration in emission of the fluorescent display device. However, application of the field emission cathode of the present invention to the fluorescent display device eliminates emission of sulfide gas from the phosphor, to thereby prevent luminescence of the fluorescent display device from being deteriorated.

Moreover, application of the field emission cathode of the present invention to the fluorescent display device permits the fluorescent display device to exhibit high luminance and high resonance and accomplish a decrease in power consumption and an improvement in durability.

While a preferred embodiment of tile invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission cathode comprising:

a monocrystalline Si substrate;

matrix-like wirings constructed of a plurality of wirings laminatedly formed on said Si substrate so as to extend in each of two directions perpendicular to each other;

circuit elements respectively formed in a plurality of element regions defined on .said Si substrate by said matrix-like wirings and each including a switching element and a storage circuit;

said circuit elements being connected at an input section thereof to said matrix-like wirings; and field emission sections each formed in each of said element regions and connected to an output section of each of said circuit elements.

2. A field emission cathode as defined in claim 1, wherein said switching element is connected to said matrix-like wirings and said storage circuit is constructed so as to store therein a signal input thereto by means of said switching element; and each of said circuit elements further includes a drive circuit for amplifying the signal stored in said storage circuit and feeding it to said field emission section.

3. A field emission cathode as defined in claim 1, further comprising a drive circuit arranged on a peripheral region of said Si substrate.

* * * * *